US006845876B2

(12) United States Patent
Helms, Jr.

(10) Patent No.: US 6,845,876 B2
(45) Date of Patent: Jan. 25, 2005

(54) EXPANDABLE SEAL ASSEMBLY APPARATUS AND METHOD

(76) Inventor: William F. Helms, Jr., SM 44, Lake Cherokee, Henderson, TX (US) 75652

( * ) Notice: Subject to any disclaimer, the term of this patent is extended or adjusted under 35 U.S.C. 154(b) by 91 days.

(21) Appl. No.: 10/176,332

(22) Filed: Jun. 20, 2002

(65) Prior Publication Data

US 2003/0234253 A1 Dec. 25, 2003

(51) Int. Cl.[7] ..... B65D 53/00

(52) U.S. Cl. ..... 220/234; 220/239; 220/233; 277/646

(58) Field of Search ..... 220/212, 234, 220/239, 233; 138/93, 90, 89; 277/331, 334, 338, 339, 583, 645, 646

(56) References Cited

U.S. PATENT DOCUMENTS 3,606,070 A * 9/1971 Shepherd ..... 220/210
3,820,682 A * 6/1974 Davella ..... 220/315
3,896,663 A * 7/1975 Ogura ..... 73/784
4,763,511 A * 8/1988 Mathison et al. ..... 73/49.1
4,991,651 A * 2/1991 Campbell ..... 166/122
6,286,553 B1 * 9/2001 Morgan ..... 138/89

* cited by examiner

*Primary Examiner*—Robin A. Hylton
(74) *Attorney, Agent, or Firm*—Jeffrey G. Degenfelder; David W. Carstens; Carstens & Cahoon, LLP

(57) ABSTRACT

The expandable seal assembly can be used to seal the contents of a container. When air pressure is applied to a chamber, rods with leaf springs on a distal end extend outward mating an expandable elastic to the inside edge of the container to be sealed. A spring-mounted ball valve maintains the pressure in the chamber when the source of the air pressure applied to the chamber is removed.

15 Claims, 6 Drawing Sheets

EXPANDABLE SEAL ASSEMBLY APPARATUS AND METHOD

BACKGROUND OF THE INVENTION

1. Technical Field of the Invention

The present invention relates generally to sealing devices to prevent product from leaking from contained area and, in particular, to a sealing device for sealing the inside of a container through a radial expansion caused by a user-applied force to the top of the seal.

2. Description of Related Art

Liquids need to be sealed in containers especially during transport to avoid spillage of the contents. Numerous methods to seal containers can be found in prior art. Many attempts have used a downward, axial force to radially exert a force in a manner meant to seal. For example, one prior art reference relates to a garbage can lid. A cross section of the lid is shown in FIG. 1. The lid operates as follows: At the end of each rod, an elastic, roughly U-shaped latch joins the distal end of the rod with the bottom of the lid roof. The annular rim of the garbage can fits snugly between the concaved U-shaped latch and the skirt wall comprising the outer diameter of the lid. When an axial force is applied on the rods in the center of the lid by pulling the handle up (away from the lid), the rods act to pull the U-shaped latches inward, increasing the space between the U-shaped latch and the outer diameter of the skirt wall. This allows the lid to be freely removed. This design, however, has its drawbacks. For example, the container can only be sealed with a lid manufactured to fit one container diameter. In other words, the diameter of the lid must fit the diameter of the can. Secondly, there is no way to seal without using a lid. For example, if one wants to transport two different fluids without mixing them, then two separate containers must purchased, loaded, shipped, unloaded and eventually discarded.

Another apparatus for sealing a fluid in a container is illustrated in FIG. 2. Here, an elastic O-Ring is attached around a frame. Attached to the top of the frame is an expandable metal snap ring. As the cam mounted in the center of the disc is rotated, the snap ring expands radially outward to fit into a circumferential groove cut into the container to be sealed. This design also has limitations. For example, a groove must be machined in the inside diameter of the container to be sealed. Furthermore, the outside diameter of the frame, and in particular the outside diameter of the elastic O-Ring must be relatively similar to the inside diameter of the area sought to be sealed.

One prior art example of a force or pressure causing a seal is illustrated in FIG. 3. When the vessel is pressurized, a pressure difference acts on the diaphragm to press an annular plate driven by the diaphragm against the O-ring while the cover is secured by a bayonet. However, absent a pressure in the vessel there is no seal. Furthermore, multiple fluids cannot be kept separate in the same container. Moreover, the lid must be tailor made to fit the container.

Consequently, a need exists for a device that can be used to seal containers with a range of inside diameters. Furthermore, a need exists for a seal that can be placed in various axial positions within a container without modifying the container.

SUMMARY OF THE INVENTION

The present invention solves these problems in the prior art. The expandable seal assembly consists of a frame containing a series of rods with leaf springs attached to the distal ends of each rod. The leaf springs are covered by an elastic material. In response to pressure applied to the rods, the rods are forced outward from the center of the frame causing the leaf spring to travel outward and stretch the outer elastic material. The expansion of the outer elastic material will cease when it has mated with the inside diameter of the container to be sealed. When the pressure source is removed from the frame, a spring loaded ball valve closes allowing the pressure within the frame to be maintained.

This expandable seal assembly of the claimed invention can operate at various axial positions within a container, within a range of different diameter containers, and at various axial positions within containers with tapered or telescoping diameters. The expandable seal assembly of the claimed invention can be used to store multiple products separately within a single container. In addition, when the leaf springs are designed to form fit the inside layer of the container being sealed, containers with non-circular inside diameters can be sealed.

BRIEF DESCRIPTION OF THE DRAWINGS

A more complete understanding of the method and apparatus of the present invention may be had by reference to the following detailed description when taken in conjunction with the accompanying drawings wherein.

DETAILED DESCRIPTION OF THE DRAWINGS

The preferred embodiment of the present invention and its advantages are best understood by referring to FIGS. 4 through 8 of the drawings, like numerals being used for like and corresponding parts of the various drawings.

Figure 1:
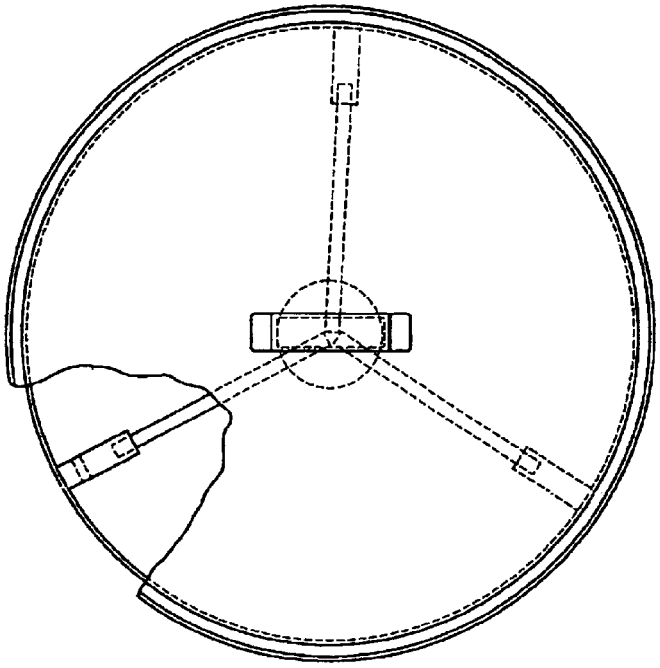
FIG. 1 (Prior Art)
FIGS. 1, 2, and 3 illustrate prior art seal assemblies.
Figure 2:
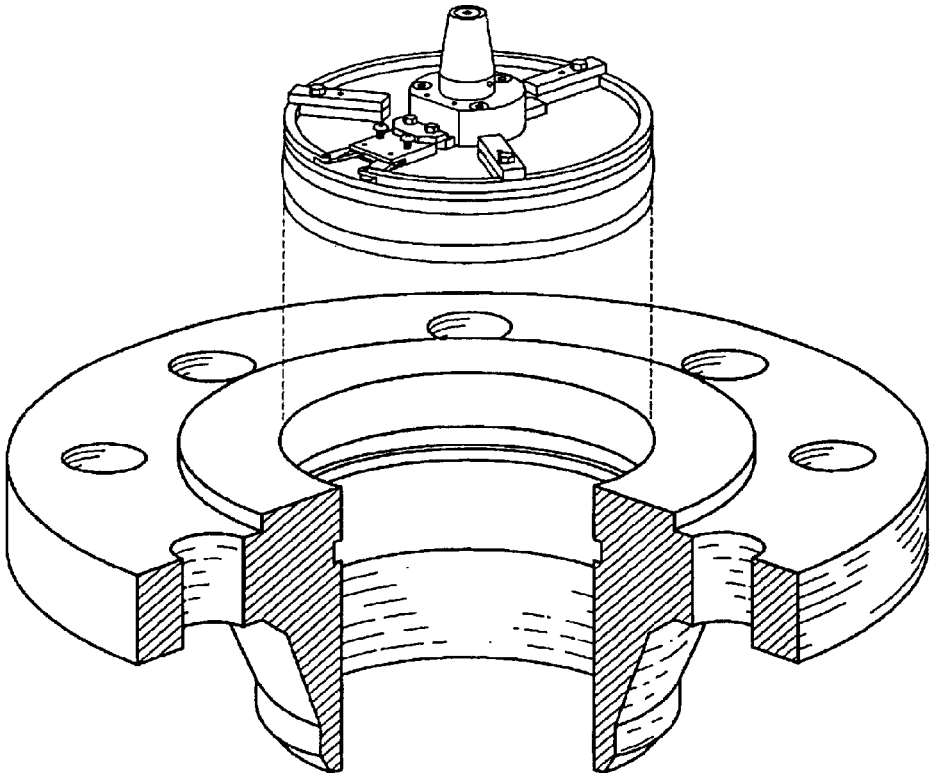
FIG. 2 (Prior Art)
Figure 3:
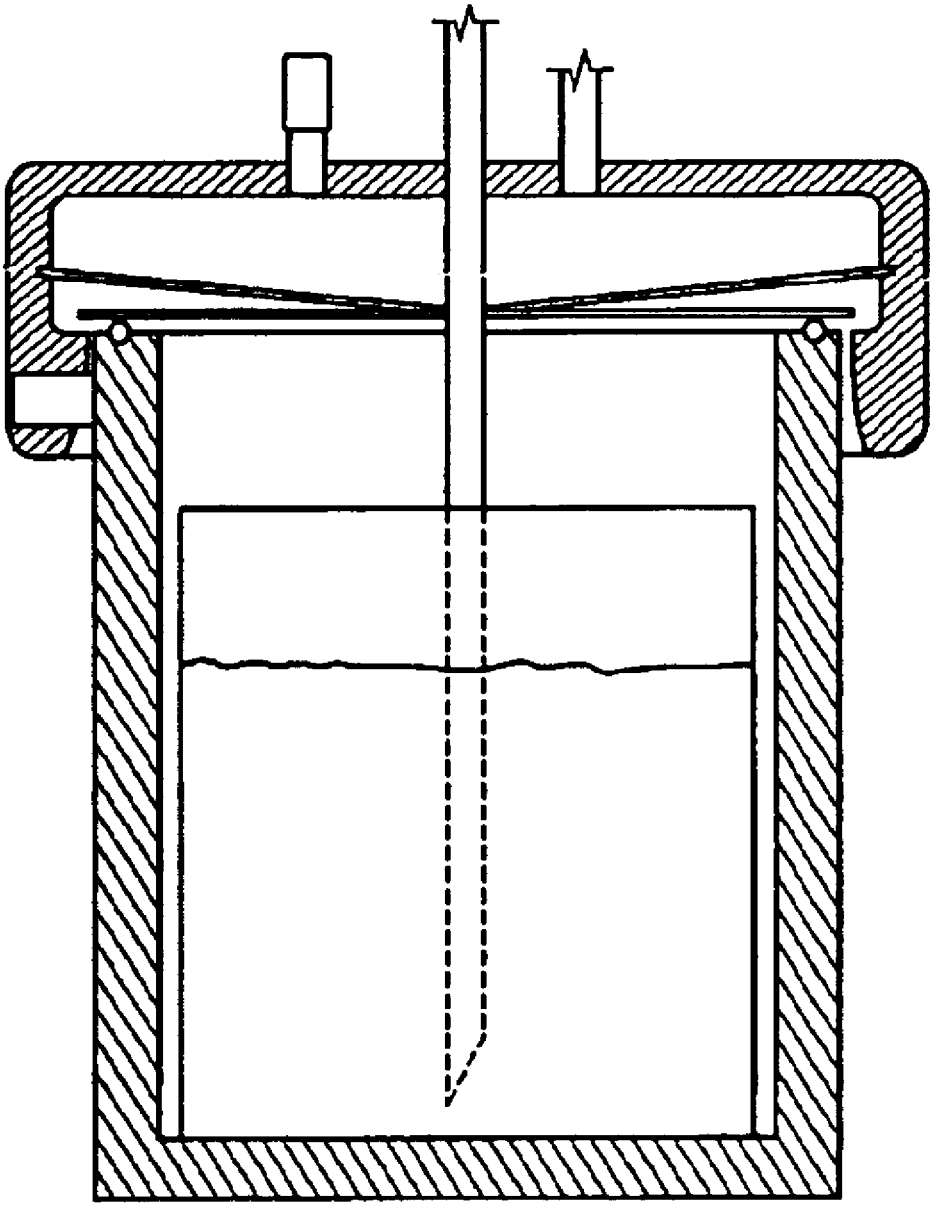
FIG. 3 (Prior Art)
Figure 4:
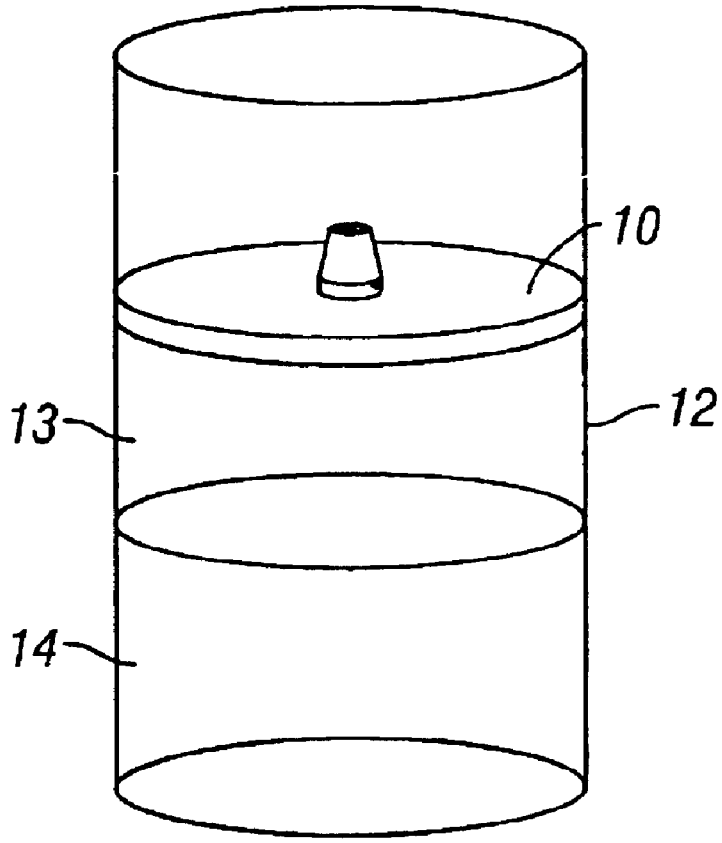
FIG. 4 is a perspective view of the application of the seal in a container above a liquid.

Referring now to FIG. 4, the seal assembly is inside a container 12 containing both a gas phase 13 and liquid phase 14. Alternatively, the seal could be used to separate two liquids. For example, if the expandable seal assembly 10 was engaged, another liquid could then be poured on top and second expandable seal assembly could be inserted above that liquid. As FIG. 5 indicates, any container with a diameter larger than the collapsed diameter 18 and up to the expanded diameter 18' can be sealed. The seal is operated by an axial force applied at the valve stem 20 and translated into radial motion. FIG. 6 shows one embodiment whereby a valve needle 22 is pushed downward against the force of a spring 30. If air at a first higher pressure is applied to the chamber, air flow will follow the direction of the arrows forcing the rod 34 with attached leaf spring 36 into elastic material 18, causing an outward radial expansion of the elastic material 18' (see FIG. 6*b*) to occur until either the rod head 32 abuts the inside wall 38 or the force produced by resistance at the leaf springs 36 equals the force applied to the rod head 32. Once pressure upon valve needle 22 is ceased the spring 30 will mate the ball 28 with the gasket 24 and maintain air pressure within the enclosure allowing the elastic material 18' to remain extended and a seal to the inside diameter of the container 12 (see FIG. 4) to be maintained. Release of the seal to the inside diameter of the container 12 occurs when a pressure applied downward on valve needle 22 allows the built-up internal pressure to escape to the atmosphere.

Figure 7A:
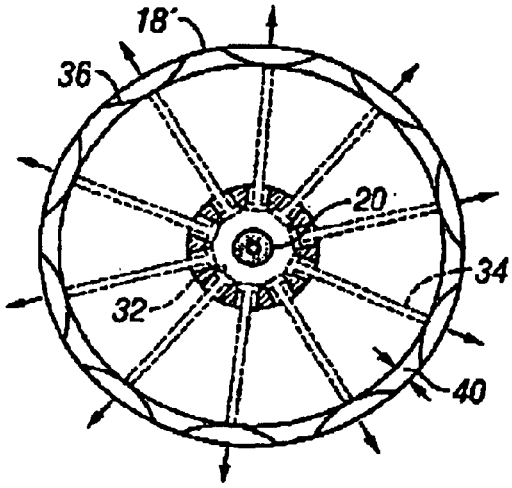
FIG. 7*a* is a cross-sectional top view of the rod and leaf spring assembly and the elastic material on the outer diameter of the frame in its collapsed position.
Figure 7B:
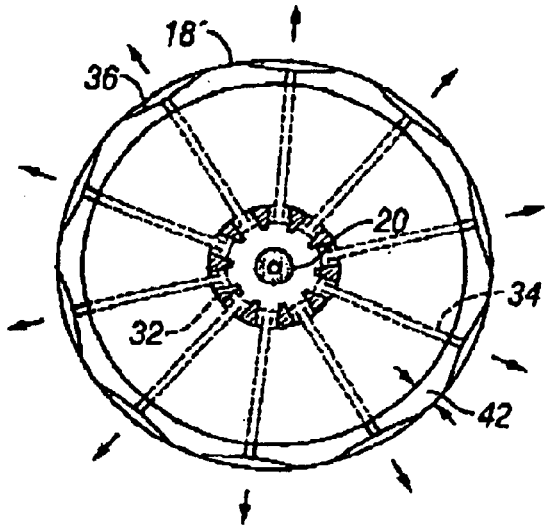
FIG. 7*b* is a cross-sectional top view of the rod and leaf spring assembly and the elastic material on the outer diameter of the frame in a partially expanded position.
Figure 7C:
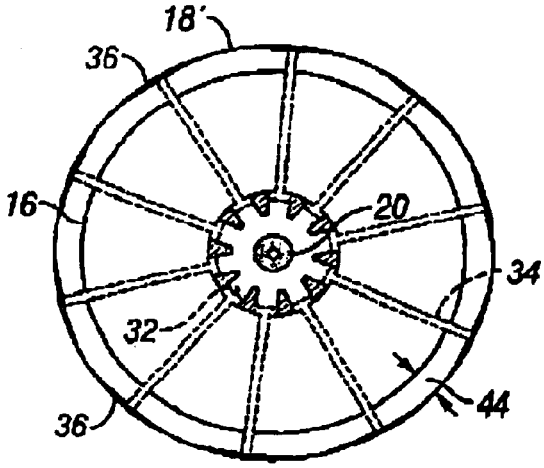
FIG. 7*c* is a cross-sectional top view of the rod and leaf spring assembly and the elastic material on the outer diameter of the frame in its fully expanded position.

FIG. 7*a* shows a top cross-sectional view of the seal lid. As air at a first higher pressure is applied to the chamber through the valve stem 20, forces will be placed on the rod handles 32. These forces will push the rods 34 and attached leaf springs 36 outward exerting a force on the expandable elastic 18'. Thus, the diameter 40 will expand in the direction as indicated by the arrows to a new diameter 42 (see FIG. 7*b*) as more air pressure is applied. The leaf springs 36 gradually become less parabolic as shown in FIG. 7B and take the form of the inside diameter of the container the leaf springs 36 are mating into when the desired seal outside diameter 44 has been reached as shown in FIG. 7C.

Figure 8:
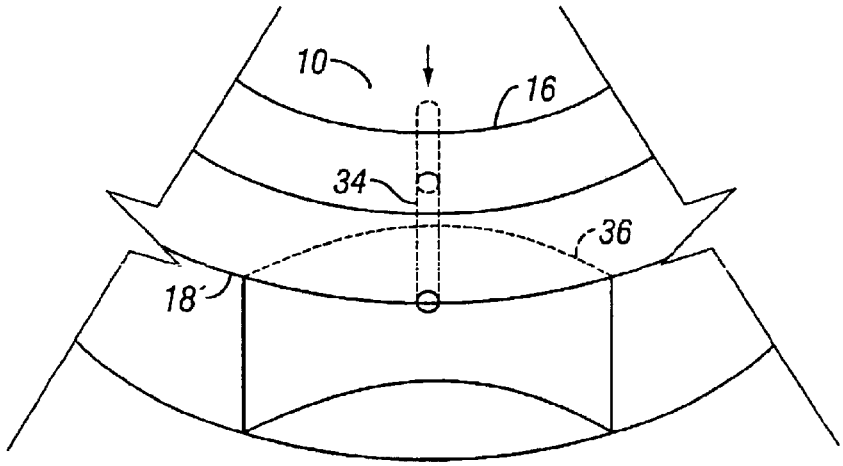
FIG. 8 is a cross-sectional view of the rod and leaf spring and the elastic material on the outer diameter of the frame in a partially expanded position.
Figure 9:
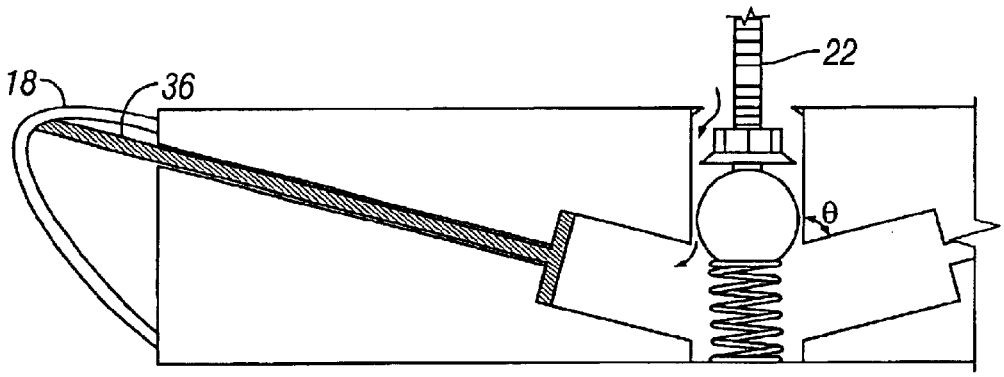
FIG. 9 is a cross-sectional side view of an angled embodiment of the valve and rod assembly and the elastic material on the outer diameter of the frame in an expanded position.

FIG. 8 is another illustration of the leaf springs 36 causing an outward radial expansion of the elastic material 18' to a larger diameter in response to a force acting on the rod 34. FIG. 9 is an illustration of another embodiment of the seal where the rods travel do not travel in a co-planar manner within the frame. Furthermore, the angle θ does not have to be equal for each rod. For example, the rod angles can be staggered where every other rod has an angle where θ=45 degrees and the remaining rods have an angle where θ=135.

Figure 5:
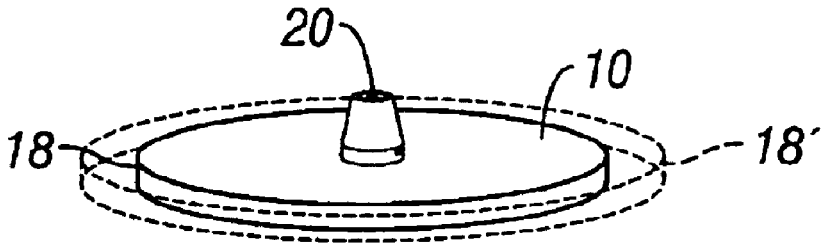
FIG. 5 shows the radial expandability of the seal.
Figure 6A:
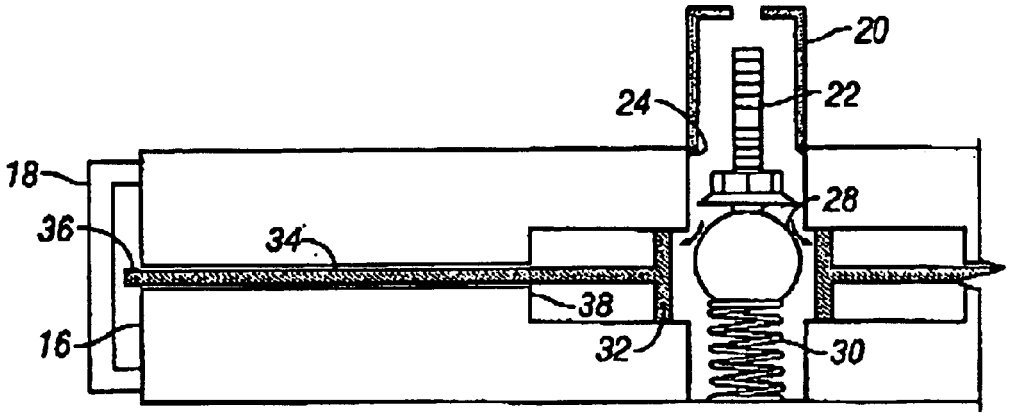
FIG. 6*a* is a cross-sectional side view of the rod and ball valve assembly and the elastic material on the outer diameter of the frame in its collapsed position.
Figure 6B:
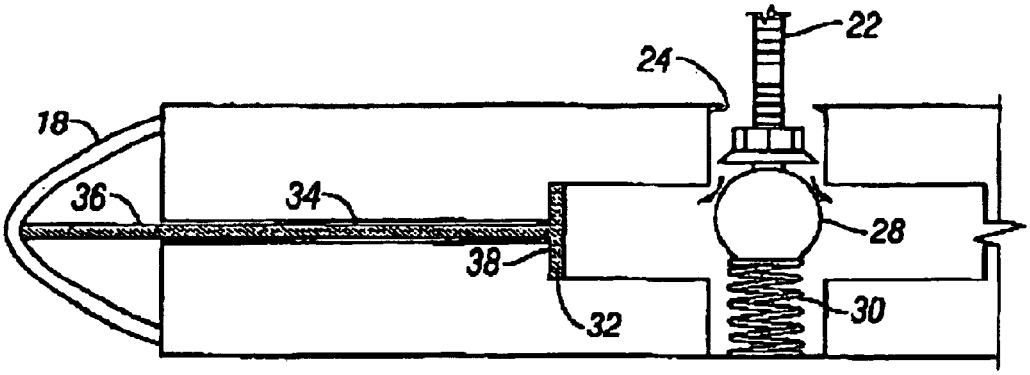
FIG. 6*b* is a cross-sectional side view of the ball valve assembly and the elastic material on the outer diameter of the frame in its expanded position.

Although the frame 10 in FIGS. 4 and 5 is shown as a circular shape, it is not limited to a circular shape. It may be desirable for the shape of the frame to match the shape of the area to be sealed. For example, one may wish to seal a rectangular duct. In such a case a rectangular frame might be desirable as it may result in a tighter seal in the corner areas.

Although a preferred embodiment of the method and apparatus of the present invention has been illustrated in the accompanying Drawings and described in the foregoing Detailed Description, it will be understood that the invention is not limited to the embodiment disclosed, but is capable of numerous rearrangements, modifications and substitutions without departing from the spirit of the invention as set forth and defined by the following claims.

What is claimed is:

1. A variable diameter seal assembly comprising:

(a) a frame having a plurality of passages and a chamber formed therein, said passages fluidly connecting said chamber to an outer peripheral surface of said frame;

(b) a plurality of rods correspondingly disposed in said plurality of passages, each of said rods having a head on one end which abuts a wall of said chamber and at least one leaf spring at a distal end, wherein the rods are radially displaced in response to a pressure in the chamber; and (c) an expandable elastic attached about said outer peripheral surface that expands in response to the rods.

2. The assembly of claim 1 wherein said chamber further comprises a ball valve assembly to selectively adjust said chamber pressure.

3. The assembly of claim 1 wherein the general shape of the frame is circular, triangular, elliptical, triangular, rectilinear, or polygonal.

4. An expandable seal assembly comprising:

(a) a frame element having a selectively sealable chamber and a plurality of passages formed therein, said passages radiating from said chamber to an outer peripheral surface of said frame element;

(b) an elastic seal element fixably attached about said outer peripheral surface;

(c) a plurality of rod elements complementary to and slidably mounted in said plurality of passages, each of said rod elements dimensioned to extend through a corresponding passage from said chamber to past said outer peripheral surface and responsive to changes in a pressure differential selectively induced between said chamber and ambient conditions;

wherein each rod element includes a head on a first end which extends into said chamber and a leaf spring attached to a distal end; said leaf spring impinging upon an inner surface of said seal element, and wherein said seal element expands and contracts radially in response to said rod elements projecting outwardly and contracting inwardly in response to said pressure differential.

5. The assembly of claim 4 wherein said selectively sealable chamber comprises a ball valve assembly.

6. The assembly of claim 4 wherein said frame element has a generally circular shape.

7. The assembly of claim 4 wherein said frame element has an generally elliptical shape.

8. The assembly of claim 4 wherein said frame element has a generally triangular shape.

9. The assembly of claim 4 wherein said frame element has a generally rectilinear shape.

10. The assembly of claim 4 wherein said frame element has a generally polygonal shape.

11. The assembly of claim 4 wherein said frame element comprises a generally planar body having two parallel planar surfaces bounding said outer peripheral surface.

12. The assembly of claim 11 wherein said passages are oriented generally parallel to said planar surfaces.

13. The assembly of claim 11 wherein said passages are oriented at an acute angle from said planar surfaces.

14. The assembly of claim 11 wherein said passages are oriented at an obtuse angle from said planar surfaces.

15. The assembly of claim 11 wherein said passages are oriented in a staggered configuration comprising an alternating acute and obtuse angle from said planar surfaces.

* * * * *